United States Patent [19]

Phares et al.

[11] 4,102,143

[45] Jul. 25, 1978

[54] ANCHORING OF STRUCTURES

[75] Inventors: Lindsey J. Phares, Sugar Land; George J. Gendron, Houston, both of Tex.

[73] Assignee: Raymond International Inc., Houston, Tex.

[21] Appl. No.: 759,028

[22] Filed: Jan. 13, 1977

[51] Int. Cl.[2] ..... E02B 17/00

[52] U.S. Cl. ..... 61/94; 24/263 D; 403/370

[58] Field of Search ..... 61/89, 98, 94, 91, 96, 61/93, 90; 285/18; 24/263 D; 403/370

[56] References Cited

U.S. PATENT DOCUMENTS

| | | | |
|---|---|---|---|
| 2,960,832 | 11/1960 | Hayward | 61/94 |
| 2,970,445 | 2/1961 | Suderow | 61/91 |
| 3,503,217 | 3/1970 | Kliewer | 61/94 |

*Primary Examiner*—Jacob Shapiro

*Attorney, Agent, or Firm*—Fitzpatrick, Cella, Harper & Scinto

[57] ABSTRACT

Anchoring arrangements for structures such as offshore towers. Wedges which fit down into spaces defined by downwardly converging surfaces fixed to the structure and to an anchor member, respectively, are held in frictional locking engagement by means of bias weights. Two sets of wedge type interlocks are provided in longitudinally displaced relationship and are arranged in reverse order so that downward bias forces on the wedges serves to provide locking against relative movement in opposite longitudinal directions.

44 Claims, 14 Drawing Figures

Fig. 1.
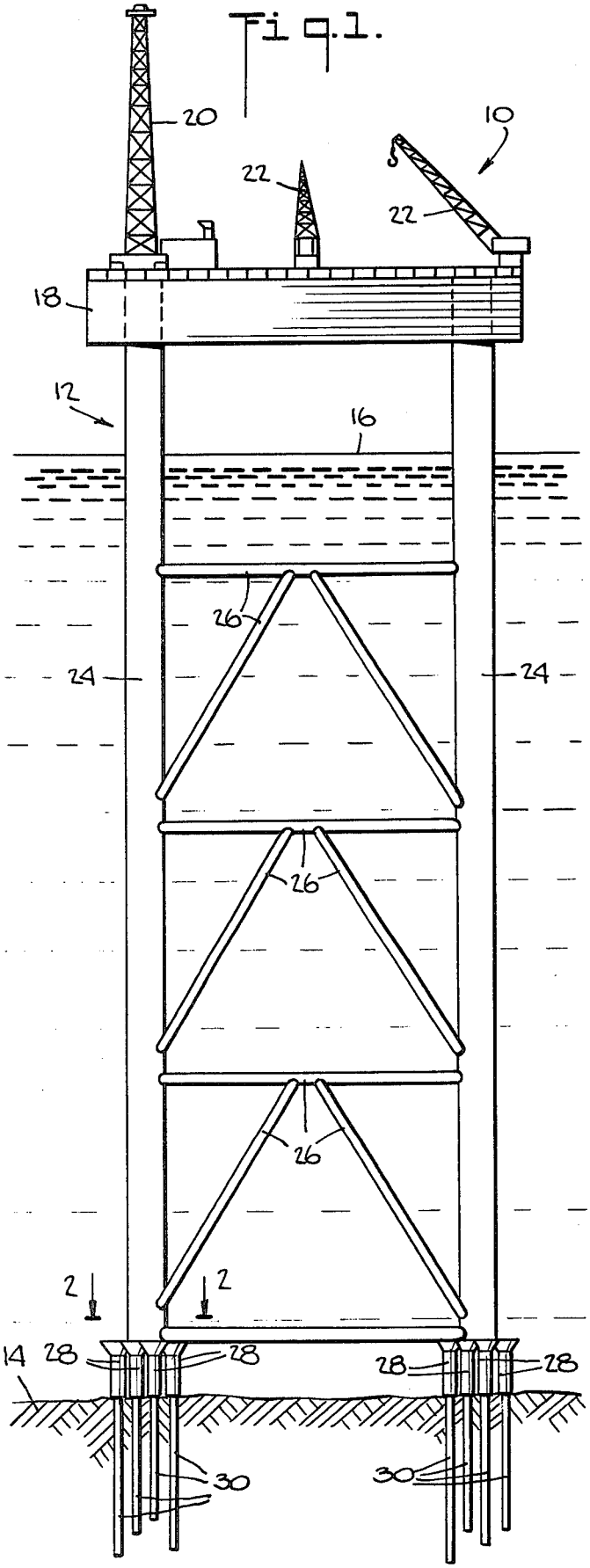
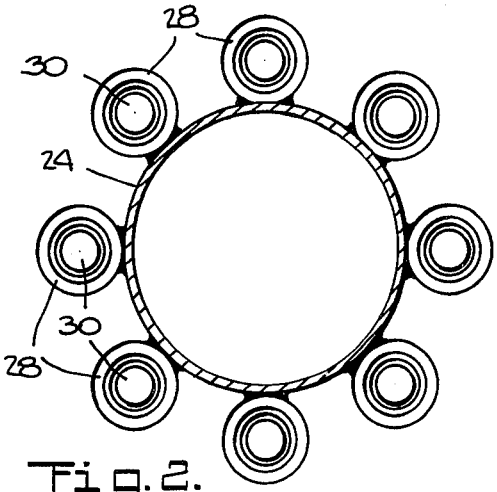
Fig. 2.
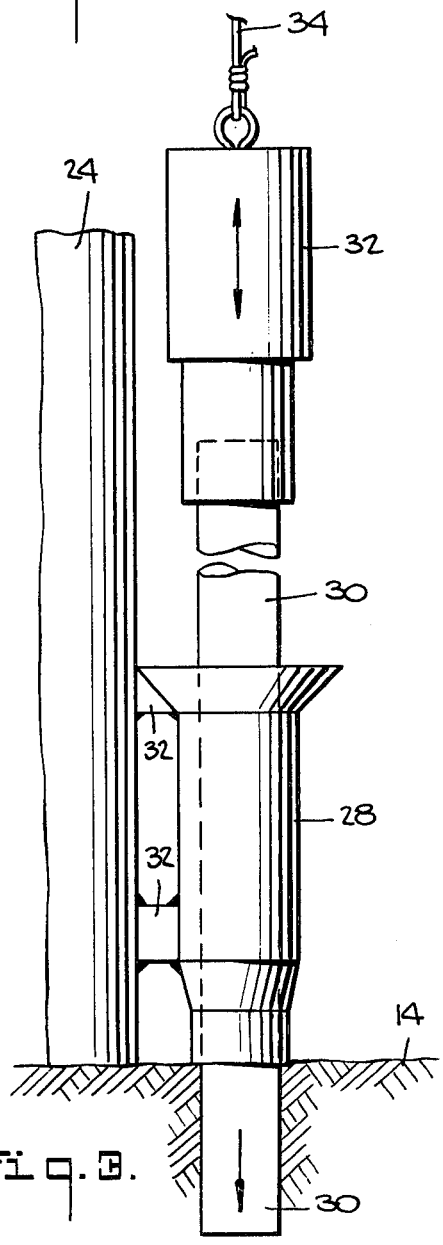
Fig. 3.

ANCHORING OF STRUCTURES

FIELD OF THE INVENTION

This invention relates to the anchoring of structure and more particularly it concerns novel methods and apparatus for securing structures to anchor piles.

BACKGROUND OF THE INVENTION

Description of the Prior Art

U.S. Pat. No. 3,857,247 to Lindsey J. Phares discloses an offshore tower which is fastened to a sea bed by means of anchor piles. These piles are driven down into the sea bed through tubular sleeves which are welded or otherwise affixed to the bottom of the tower. After the anchor piles have been driven, their upper ends, which are inside the sleeves, are locked to the sleeves by pumping grout or similar material down into the annular clearance between the pile and the sleeve. The grout then hardens to transfer loading stresses from the sleeve to the pile.

In order to be certain that the grout connection between the pile and the sleeve is complete and secure with an adequate margin of safety, it has been the practice in the art to provide elongated sleeves, e.g., more than 100 feet (30 meters) long so that a large area is available for grout interconnection. However, this proves to be quite costly. In addition, steel bars or rods, known as "shear connectors" are often welded to adjacent sleeve and pile surfaces to serve as keys for enhancing the grout locking action.

The use of grout for locking anchor piles to sleeves in depths of as much as 500 to 600 feet, has been quite difficult to carry out in a reliable manner because the grout has to be pumped over a great distance and there is no reliable way of ascertaining whether the grout has fully filled the space between each sleeve and its associated anchor pile.

It is important in anchoring an offshore tower to provide a positive locking action not only against downward loading imposed by the weight of the tower, but also to resist lateral loading and upward loading caused by the effects of wind, waves and water currents on the tower. These various effects, moreover are changeable and sporadic; and thus the locking arrangements must be capable of operating to prevent relative movement in different directions and they must not be affected by sudden strains and shocks. Also they must be capable of sustaining this locking effect over long periods of time, e.g., forty years, without maintenance.

Various other interconnecting arrangements have been employed in the prior art for locking an elongated member inside a sleeve, but none of them were capable of providing bi-directional locking in a reliable manner. One prior art locking arrangement is shown in U.S. Pat. No. 2,784,015 to C. G. Swanson. This patent shows a tubular outer sleeve-like member which is locked to an inner elongated member by means of two sets of wedges inserted between tapered facing surfaces of the elongated member and the sleeve. The wedges of the two sets act in mutually opposite directions to provide a bi-directional lock and they are held in locking engagement by means of tension rods which extend between the wedges of each group.

The Swanson wedge arrangement is unsuitable for long term locking of a sleeve to an elongated member where the elongated member is subjected to variously applied stresses in different directions. This is because the tension members of Swanson are subject to stretching from the long term effects of bending and stretching caused by wind or other elements acting on the sleeve and elongated member. As a result the forces holding the wedges in locked condition are not reliably maintained. Also, the Swanson wedges must be assembled by a workman working directly with them. They are not suited for installation at large water depths, e.g., 500 to 600 feet (150–180 meters) by operations carried out from above the surface of the water.

SUMMARY OF THE INVENTION

The present invention overcomes the above-described disadvantages of the prior art and it provides novel anchoring arrangements for anchoring a structure in a simple yet reliable manner which remains effective under adverse conditions, e.g., in submerged locations, over long periods of time, e.g., as long as forty years, without maintenance.

The anchoring arrangements of the present invention are easily carried out; in fact, they may be assembled at a sea bed by operations controlled from above the surface of the sea. In addition, the anchoring arrangements of the present invention provide locking in opposite longitudinal directions and therefore they are effective to restrain an offshore tower against the stresses imposed by winds, waves and water currents acting on the tower in different directions at different times. Further, the anchoring arrangements of the present invention are essentially unaffected by sudden stresses and shock loadings to which an offshore tower may be subjected.

The anchoring arrangements of the present invention are also considerably less expensive than those of the prior art because they permit the use of sleeves which are shorter than those required for the prior art grout locking technique and they do not require the grout pumping devices and transmission lines which were previously required.

According to one aspect of the present invention there are provided novel arrangements whereby a structure is locked to an elongated anchor member. The anchor member and the structure are provided with mutually facing surface portions that converge toward each other in a downward direction. Wedges which are shaped to fit inside the space defined by converging surface portions are lowered into the space so as to frictionally engage these surface portions. A bias weight is then lowered onto the wedges to hold them in locking frictional engagement with the converging surfaces. The bias weight maintains the system in locked condition over extended periods of time without maintenance and it is not affected over the long term by shocks, sudden stresses, or by corrosion wear, etc. This aspect of the invention is readily adapted to the anchoring of an offshore tower wherein the tower has sleeves affixed to its lower end with the sleeves accommodating anchor piles which are locked to and extend up from the sea bed. In this case the sleeve and anchor members are formed with mutually facing downwardly converging surfaces in the annular space between them and wedges are positioned in this space and bias weight means are lowered down onto the tops of the wedges.

According to a further aspect of the invention there are provided novel arrangements whereby a structure is locked to an elongated anchor member in a manner which resists longitudinal movement in opposite longitudinal directions. This bidirectional locking is obtained by means of two sets of locking assemblies longitudinally positioned from each other. One locking assembly includes a first surface fixed with respect to the anchor member and inclined toward a corresponding surface fixed with respect to the structure, so that the surfaces converge as they extend in a first longitudinal direction. The other locking assembly includes a first surface fixed with respect to the structure and inclined toward a corresponding surface fixed with respect to the anchor member, so that these surfaces also converge as they extend in the same first direction. Wedges are placed between the mutually converging surfaces of the two locking assemblies to frictionally engage and lock with those surfaces. Bias means are arranged to force the wedges in the two locking assemblies in the first longitudinal direction to hold the wedges in frictionally locking engagement. Even though the wedge bias is in the same direction in each locking assembly the two locking assemblies restrict against relative motion in two opposite directions. This second aspect of the invention is particularly suited to the locking of offshore towers because it allows for the application of unidirectional, e.g., downward, bias forces or sets of wedges which in turn act to lock against relative movement in different direction, i.e. up and down. Thus, in an offshore tower an easily assembled wedge type interlock is provided and yet this interlock holds the tower anchored against the up and down forces on each of its legs with respect to the piles anchoring the legs when the tower is subjected to the varying and changeable forces of wind, waves and water currents.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures or methods for carrying out the several purposes of the invention. It is important, therefore, that the claims be regarded as including such equivalent constructions and methods as do not depart from the spirit and scope of the invention.

BRIEF DESCRIPTION OF THE DRAWINGS

Certain specific embodiments of the invention have been chosen for purposes of illustration and description, and are shown in the accompanying drawings, forming a part of the specification wherein:

FIG. 1 is an elevational view of an offshore tower which is anchored in the sea bed by anchoring apparatus of the present invention;

FIG. 2 is an enlarged section view taken along lines 2—2 of FIG. 1;

FIG. 3 is an enlarged fragmentary view showing the driving of a pile anchor member through a sleeve member on the offshore tower as a first step in anchoring the tower to the sea bed in accordance with the present invention;

DESCRIPTION OF THE PREFERRED EMBODIMENTS OF THE INVENTION

Figure 7:
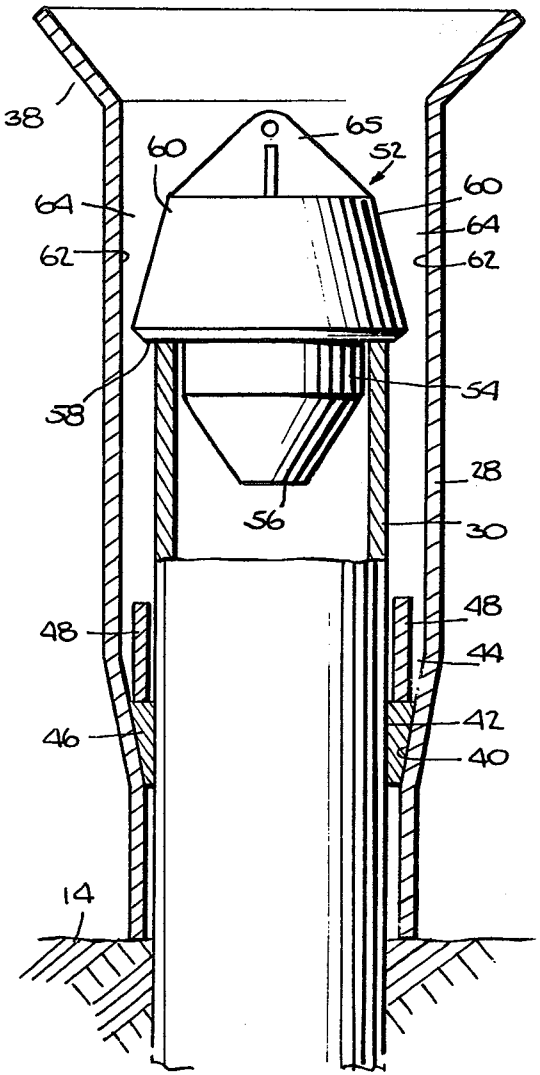
FIGS. 6, 7 and 8 are views similar to FIG. 4 but showing additional apparatus used in carrying out third, fourth and fifth steps, respectively in the anchoring of the tower to the sea bed.

In FIG. 1 there is shown an offshore tower 10, comprising a framework type template 12 which rests on a sea bed 14 and extends up past the sea surface 16 to support a platform 18 up out of the wave and tide action which occurs at the sea surface. The platform 18, in most cases, is used for exploratory drilling and for the pumping of oil up from under the sea bed; and accordingly a drilling tower 20, derricks 22 and other equipment (not shown) suitable for this purpose may be provided on the platform. The platform 18 may be constructed separately from the template 12 and assembled onto the template after the template has been anchored to the sea bed 14, or the platform and template may be preassembled and set up on location as an integral unit. The present invention however is not concerned with the specific relationship between the template and platform but rather it is concerned with the methods and apparatus for anchoring the structure in place.

As can be seen in FIG. 1 the template 12 is made up of a plurality of upstanding legs 24 which are held in fixed relationship to each other by elongated framework members 26. The lower end of each of the legs 24 rests on the sea bed 14. As can be seen in both FIGS. 1 and 2 a plurality of tubular sleeves 28 are arranged about the outside of each leg and are affixed to the leg by welding or other means. Elongated anchor piles 30 extend down through the sleeves 28 and are driven into the sea bed 14. The anchor piles are driven down to a depth where they become securely anchored against both tensile and compressive loads. Means, to be described hereinafter, are provided to lock the anchor piles 30 to the sleeves 28 in accordance with the present invention.

FIG. 3 illustrates the manner in which the anchor piles 30 are driven down through the sleeves 28 and into the sea bed 14 when the tower 10 is installed. As can be seen in FIG. 3 a sleeve 28 is attached via brackets 32 to the outside of a template leg 24 near its lower end so that the sleeve extends up along the leg 12 from the sea bed 14. An anchor pile 30 is inserted down through the upper end of the sleeve and is passed through the sleeve which guides it as it is driven down into the sea bed. The pile 30 is driven by hammer means 32, which may be of any type well known in the art. The hammer means is suspended by means of a cable 34 or other suitable means extending up past the sea surface 16 from where the hammering operation is controlled. For example, the pile installation and hammering operations may be controlled by means of the derricks 22 on the platform 18 or on some other temporary platform mounted near the upper end of the template legs 12.

Figure 4:
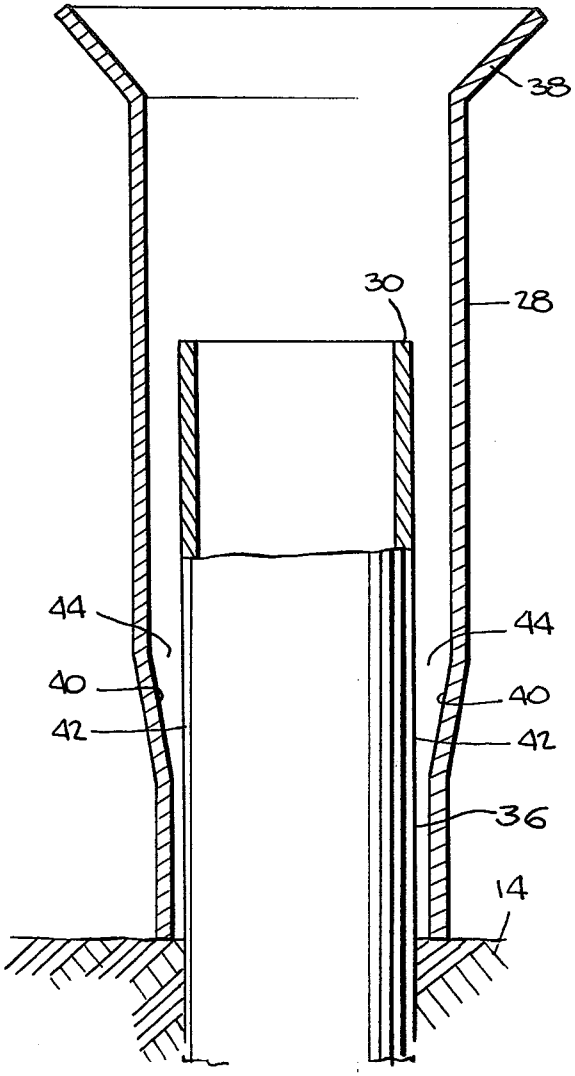
FIG. 4 is a further enlarged elevational section view showing the structural relationship of the anchor and sleeve members of FIG. 3.

As shown in FIG. 4, the sleeve 28 is of elongated tubular configuration and it allows the anchor member 30 to pass through it with a small annular clearance 36. An outwardly flared section or stabbing point 38 is provided on the upper end of the sleeve to accommodate the lower end of the anchor pile 30 and guide it into the sleeve as the pile is lowered downwardly to the sea bed 14. Toward its lower end the sleeve 28 is provided with an inwardly tapered surface region or bowl 40 which faces and is inclined inwardly toward a corresponding surface region 42 on the anchor pile 30 as the surface regions 40 and 42 extend downwardly. This serves to form a downwardly tapering annular space 44 between the sleeve and the pile near the lower end of the sleeve.

In the present embodiment, as shown in FIG. 4, the anchor pile 30 is driven until its upper end is down inside the sleeve 28 below the stabbing point 38. As will be described hereinafter, this permits assembly of the upper locking assembly used in this embodiment.

Figure 5:
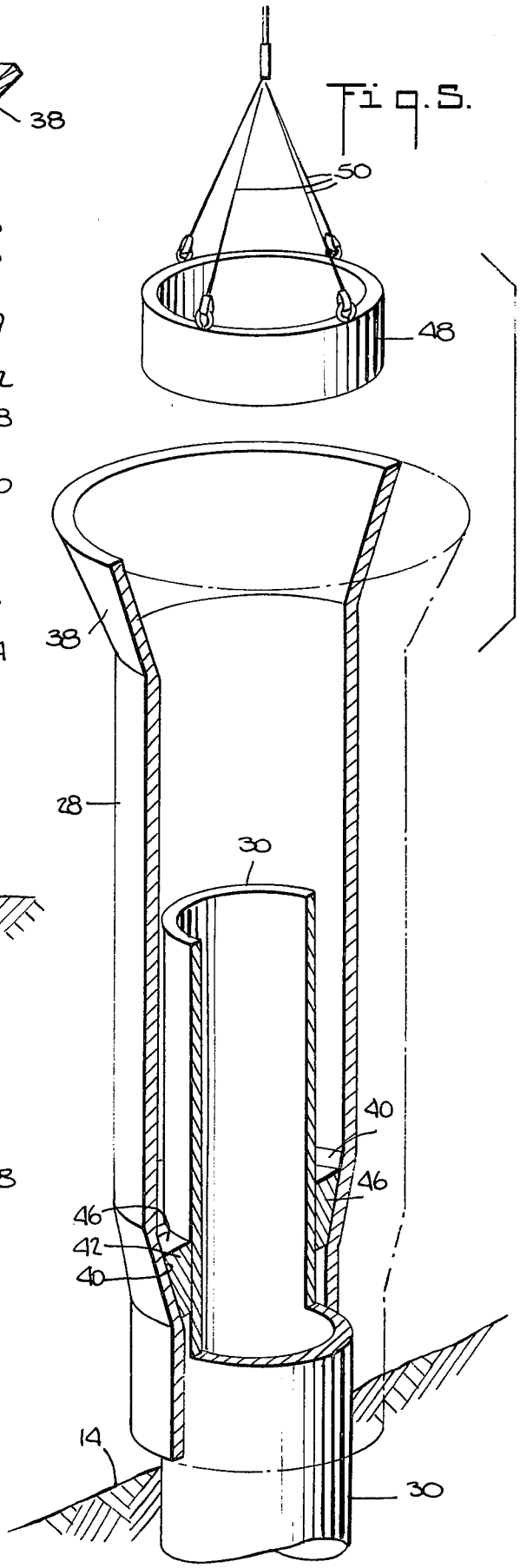
FIG. 5 is a perspective view, partially cut away, and illustrating the sleeve and anchor members and other apparatus used in carrying out a second step in the anchoring of the tower to the sea bed in accordance with the present invention.

Turning now to FIG. 5 it will be seen that a plurality of wedges 46 are lowered into the downwardly tapering annular space 44. These wedges have surfaces which engage the tapering and corresponding surface regions 40 and 42 of the sleeve and pile respectively; and when the wedges 46 are forced downwardly into the space 44 a high degree of friction builds up between these various engaging surfaces to lock the sleeve 28 to the pile 30. The wedges 46, whfich are made of hardened steel, may be commercially available slips which are used in conventional oil drilling rigs for handling lengths of drill pipe.

In order to maintain the downward force which causes the wedges 46 to continue its locking engagement with the sleeve and pile a bias weight means 48, also known as a parasitic weight, of annular configuration is lowered down, as by a cable harness 50 as shown in FIG. 5 so that it comes to rest on top of the wedges. The parasitic weight 48 is shown as a single annular element; however it may also comprise a plurality of segments in annular array with each segment resting upon and biasing a corresponding one of the wedges 46. In addition the weight 48 may be individual weights each added in or formed integrally with associated ones of the wedges 46.

Figure 6:
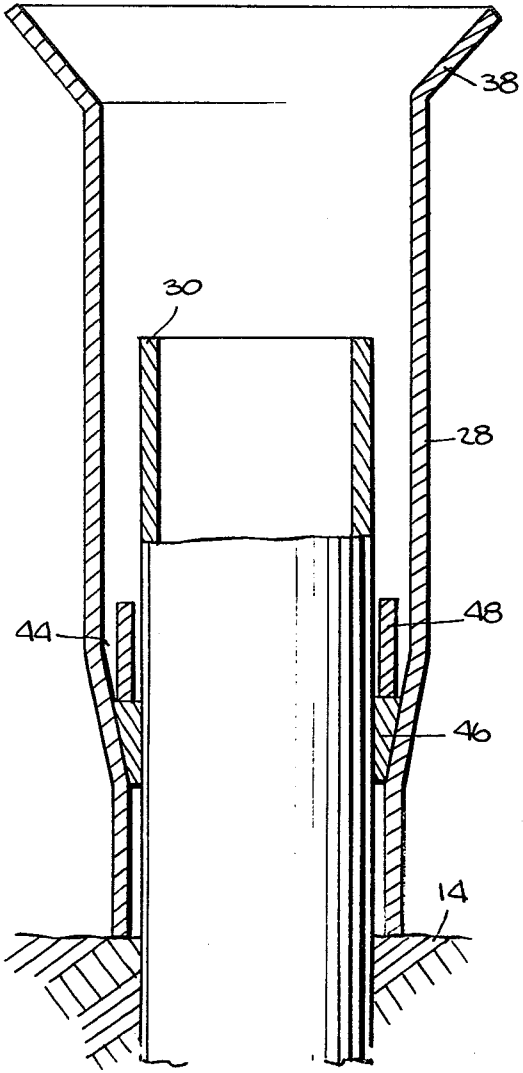

FIG. 6 illustrates in side elevation the arrangement of the wedges 46 and the parasitic weight 48 and the engagement of the wedges with the inwardly tapered surface region 40 and the corresponding surface region 42 of the sleeve and anchor pile. This arrangement constitutes a lower locking assembly; and it restrains the sleeve 28 from upward movement with respect to the anchor pile 30. It will be appreciated that as the sleeve 28 is pulled upwardly the upward pulling force on the sleeve serves to increase the squeezing effect of the surface regions 40 and 42 on the wedges 46 since the wedges are maintained in engagement with these surface regions by the parasitic weight 48. Thus any upward pull on the sleeve actually causes it to become more tightly locked to the anchor pile 30. It will also be appreciated that the forces holding the wedges in engagement with the surface regions 40 and 42 are unaffected by stresses, strains, wear, fatigue, corrosion, leakage or any of the other effects which, over long periods of time, caused prior art clamping arrangements to loosen. Further, if the sleeve 28 should move downwardly for some reason, the continuous bias provided by the weights will reestablish locking engagement of the wedges. With the present invention the forces which hold the wedges 46 in locking engagement are maintained by the parasitic weight 48; and these forces are maintained continuously and reliably over indefinite periods of time.

While the surface regions 40 and 42 are shown to be integrally formed on the sleeve and anchor members 28 and 30 respectively it is to be understood that those surface regions may be provided on intermediate members, e.g., liners or shoes, which in turn are connected or attached to the sleeve and anchor member. It is only important that the inclined surface region 40 be held against downward movement with respect to the sleeve 28 and that the corresponding surface region 42 be held against upward movement with respect to the anchor pile 30.

In order to restrain the sleeve 28 from downward movement with respect to the anchor pile 30 there is provided a second or upper locking assembly longitudinally space apart from the above-described lower locking assembly. This upper locking assembly is formed, first by installing a locking cap 52 at the upper end of the anchor pile 30 as shown in FIG. 7. The locking cap 52 has a lower cylindrical locating extension 54 which its closely inside an upper hollow region of the anchor pile 30. In addition, there is provided a downwardly tapering tip 56 at the lower end of the extension 54 so that when the cap 52 is lowered down onto the anchor pile 30 the tip 56 will guide the extension 54 into the upper end of the pile. The cap 52 is also formed with an annular outwardly extending flange surface 58 which rests on top of the anchor pile. The upper end of the cap 52 is provided with an inwardly tapering or conical surface region or stabbing point 60 which faces and is inclined outwardly toward a corresponding surface region 62 on the sleeve 28 as the surface regions 60 and 62 extend downwardly. This serves to form a second downwardly tapering annular space 64 between the sleeve 28 and the locking cap 52 on the anchor pile 30. An extension 65 is provided at the top of the cap 52 for engagement by a lifting hook (not shown) so that the cap can be lowered down on top of the anchor pile 30.

Figure 8:
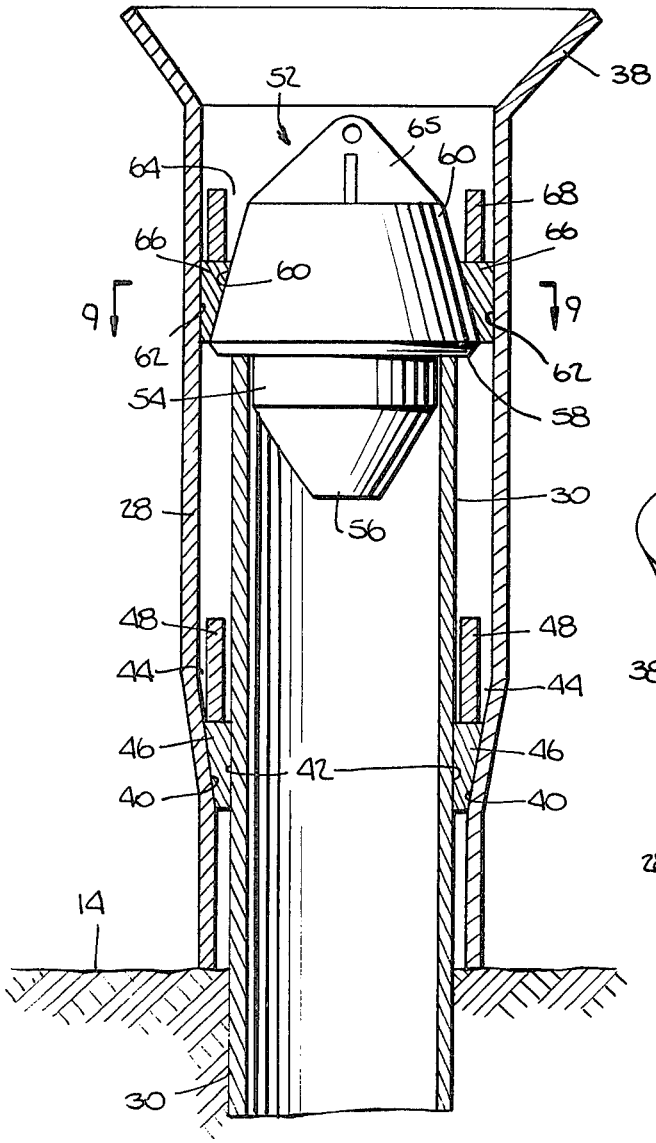

Turning now to FIG. 8 it will be seen that a plurality of upper wedges 66 are lowered into the second downwardly tapering annular space 64. These wedges, like the wedges 46, have surfaces which engage the tapering and corresponding surface regions 60 and 62 of the locking cap and sleeve respectively; and when the wedges 66 are forced downwardly into the space 64 a high degree of friction builds up between the engaging surfaces to lock the sleeve to the locking cap 52, and through the locking cap 52 to the pile 30.

An upper bias or parasitic weight means 68, which may be of the same construction as the parasitic weight 48, is then lowered down on top of the upper wedges 66 to provide a continuous downward force on the wedges so that they remain in locking engagement between the tapering and corresponding surface regions 60 and 62 to lock the sleeve to the pile. The upper parasitic weight 68 itself may comprise a plurality of individual segments.

Figure 9:
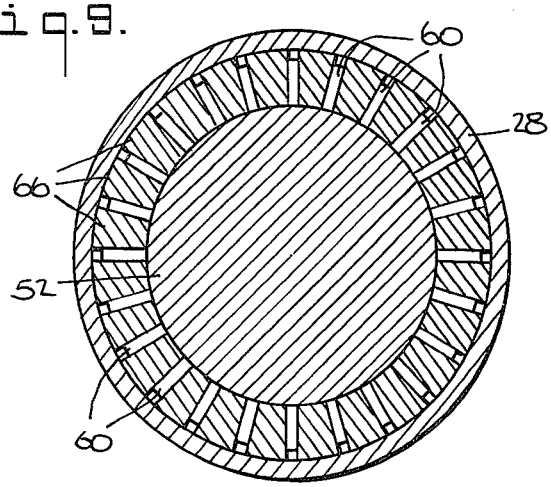
FIG. 9 is an enlarged cross section view taken along line 9—9 of FIG. 8.

FIG. 9 shows the arrangement of individual wedges 66 in annular array and engaging the tapered and corresponding surfaces 60 and 62 of the locking cap 52 and sleeve 28. This arrangement of the wedges 66 and the surfaces 60 and 62 which they engage constitutes an upper locking assembly which restrains the sleeve 28 from downward movement with respect to the anchor pile 30. It will be appreciated that as the sleeve 28 is forced downwardly, the downward force on the sleeve serves to increase the squeezing effect of the surface regions 60 and 62 on the wedges 66 since the wedges are maintained in engagement with these surface regions by the parasitic weight 68. Thus any downward force on the sleeve actually causes it to become more tightly locked to the cap 52 which in turn is restrained by its flange surface 58 from downward movement with respect to the anchor pile 30. As in the case of the lower locking assembly the upper locking assembly is also unaffected by stresses, strains, wear, fatigue corrosion, leakage or other long term effects which cause prior art clamping arrangements to loosen.

It will be noted that the locking cap 52 merely rests on top of the anchor pile 30 and it need not be attached to the anchor pile in any other way. This is because the upper locking assembly serves to lock the sleeve 28 against downward movements with respect to the anchor pile 30. Thus, the arrangement of the flange surface 58 resting on the top of the pile 30 to prevent the cap from downward movement relative to the pile suffices for the upper locking assembly. In other words, it is only necessary that the tapering surface region 60 be held against downward movement with respect to the anchor pile 30.

In the same manner it is not necessary that the corresponding surface region 62 on the sleeve 28 be integral with the sleeve. It may be formed on a separate member, such as a liner or a shoe; and it is merely necessary that it be held against upward movement with respect to the sleeve 28.

Reverting now to FIG. 1, it will be seen that when the portion of the tower 10 above the water is subjected to wind and water movements it tends to tip about its lower end so that the anchor piles on the leeward or downstream side become subjected to compressive or downward stresses while the anchor piles on the windward or upstream side become subjected to tensile or upward stresses. Wind and water action from the opposite direction will, of coure, produce opposite stresses in the various anchor piles. It will thus be appreciated that the interconnections between the sleeves 28 and their associated anchor piles 30 must be capable of withstanding forces in opposite longitudinal directions. As will be seen from the foregoing the locking assemblies described herein serve to withstand these oppositely directed forces.

The present invention makes use of bias weights in combination with wedge type locking arrangements to provide a pile to sleeve interlock which is strong, reliable and long lasting and which is easily assembled in great water depths. Moreover, because of the particular relationships of inclined and tapered wedge engaging surfaces described herein there is provided a system which locks against relative sleeve to pile movement in opposite directions while employing single direction wedge engaging forces. Thu with the present invention it is possible to employ bias weights which exert downward forces on the wedges of both the upper and lower locking assemblies and yet the wedges of the two locking assemblies serve to lock against relative movement in opposite directions.

Figure 10:
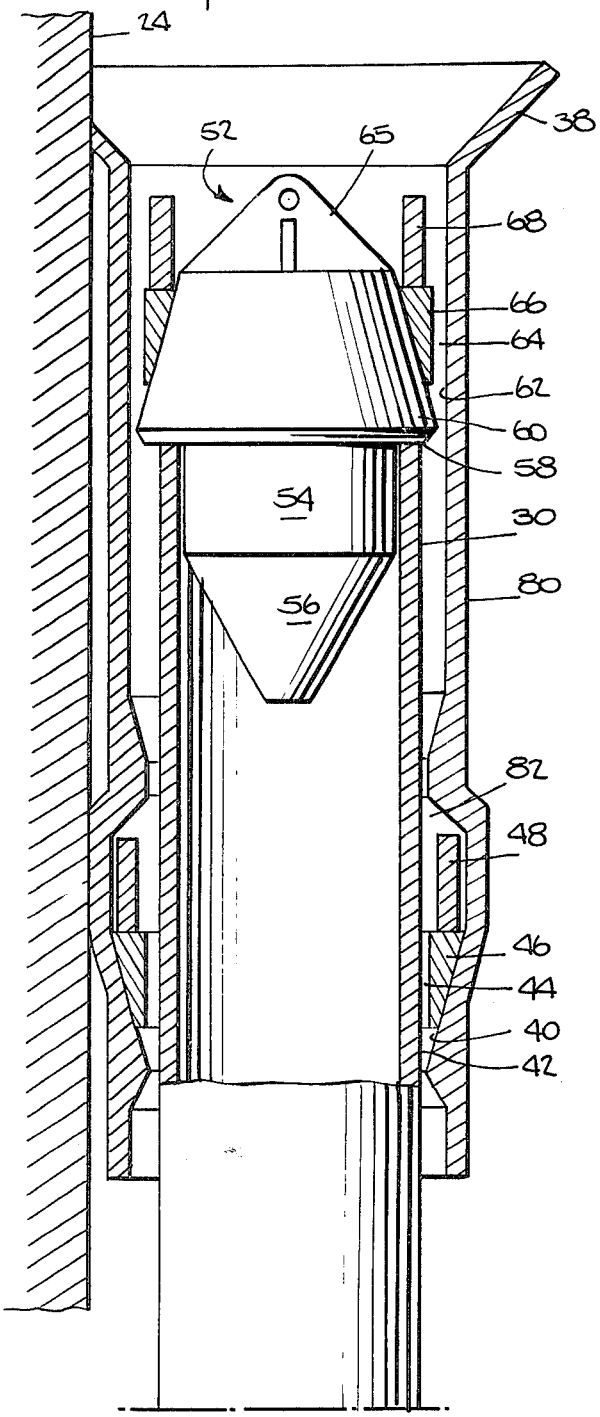
FIGS. 10 and 11 are elevational section views similar to FIG. 7 but showing successive steps in the installation of an alternate anchoring arrangement according to the present invention.
Figure 11:
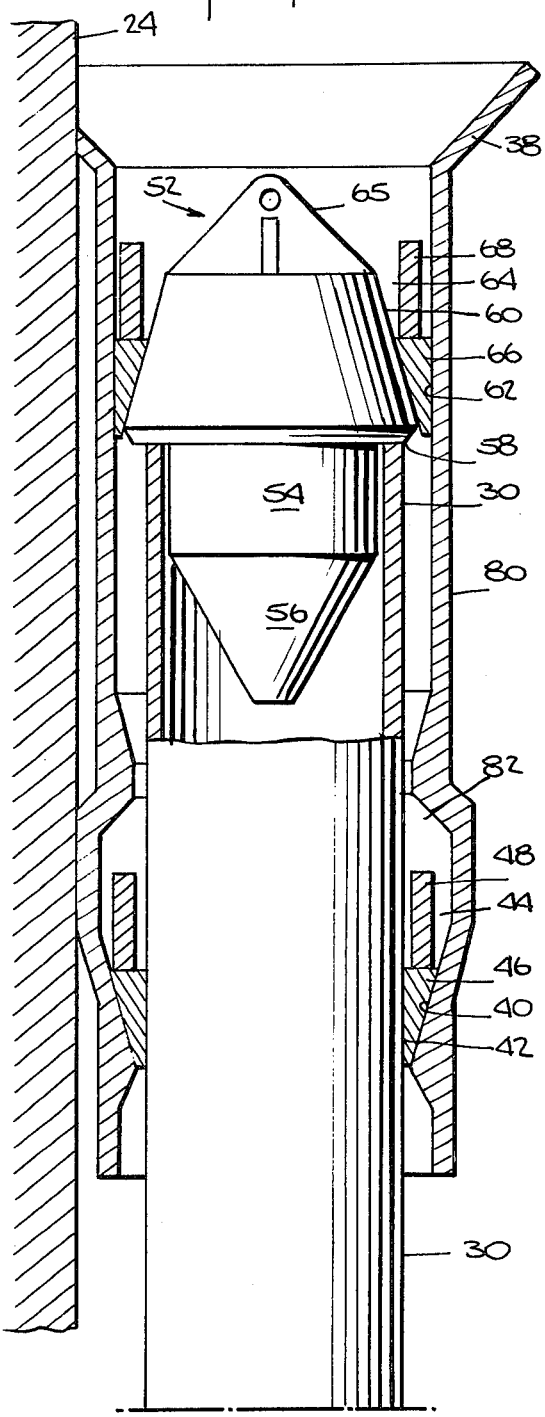

FIGS. 10 and 11 show an alternate arrangement for assembling and engaging the locking assemblies. As shown in FIG. 10 there is provided a tubular sleeve member 80 which is generally similar to the sleeve member 28 of the preceding embodiment. The sleeve member 80 extend around the anchor pile 30 as in the preceding embodiment; and there is provided a locking cap 52, lower and upper wedges 46 and 66 and lower and upper parasitic weight means 48 and 68 which operate as in the preceding embodiment.

The embodiment of FIGS. 10 and 11 differs from the preceding embodiment in that the region of the sleeve member 80 above the lower wedges 46 and lower parasitic weight means 48 is of smaller diameter than the sleeve member 38 of the preceding embodiment so that it more closely accommodates the anchor pile 30 for better guidance thereof during driving. Also, the inwardly tapered surface region 40 for the lower wedges 46 is elongated and the inner walls of the sleeve member above that surface region extend upwardly for a distance and then taper back inwardly to define an annular cavity 82 in which the wedges 46 and the parasitic weight means 48 are accommodated with the wedges positioned up and out of engagement with the anchor pile 30. The lower parasitic weight means 48 in the embodiment of FIGS. 10 and 11 is made up of a plurality of setments each corresponding to and resting upon an associated one of the wedges 46. This permits both the wedges and their respective bias weights to move outwardly and away from each other as they move up along the surface 40 inside the cavity 82, and, to move back toward each other and closer about the anchor pile 30 as they slide downwardly along the inclined surface 40.

Prior to installation of the offshore tower 10 (FIG. 1) the sleeves 80, which are secured to the lower ends of the tower legs 24, are fitted with the lower wedges 46 and bias weight means 48. Any temporary releasable means (not shown) such as explosive bolts, wire hangers or the like, may be provided to hold the wedges and parasitic weight means 46 and 48 up inside the cavity 82 so that the anchor pile 30 can pass freely through the sleeve 80 when it is driven down into the sea bed. After the anchor pile has been driven, the locking cap 52 and the upper wedges and parasitic weight 66 and 68 are lowered into place so that the assembly appears as shown in FIG. 10. The temporary release means is then released so that lower wedges 46 and lower bias weight means 48 fall downwardly in the cavity 82 and the parasitic weight segments force their respective wedges into frictional locking engagement between the anchor pile and the sleeve as shown in FIG. 11.

In each of the embodiments thus far described, the anchor pile was driven until its upper end was down inside the sleeve so that the wedging surfaces of the locking cap which rested on top of the pile could cooperate with the sleeve surfaces to form the upper locking assembly.

Figure 14:
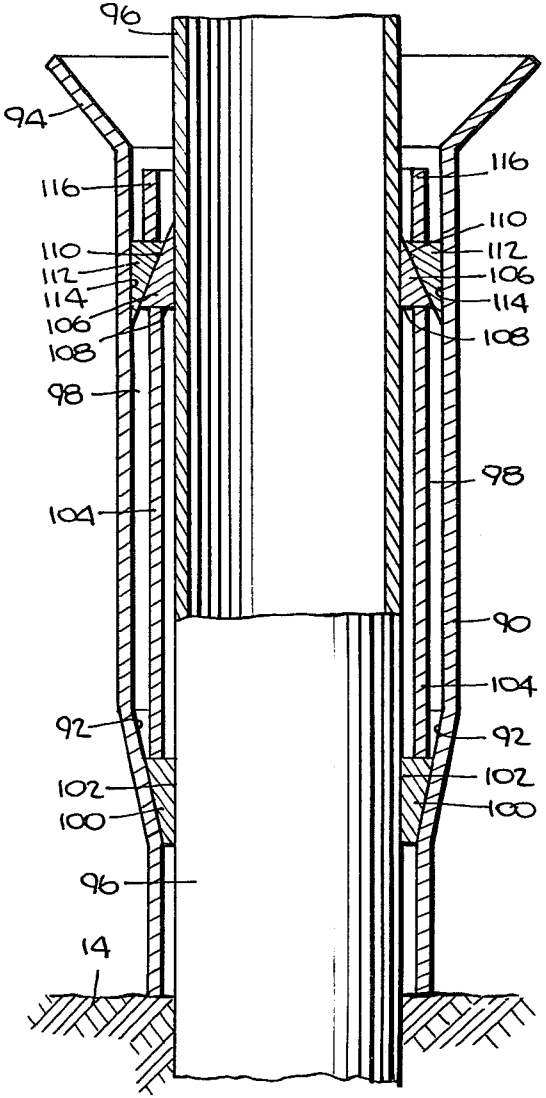
FIGS. 12–14 are elevational section views similar to FIGS. 4, 6 and 8 but showing successive steps in the installation of a further anchoring arrangement according to the present invention.
Figure 13:
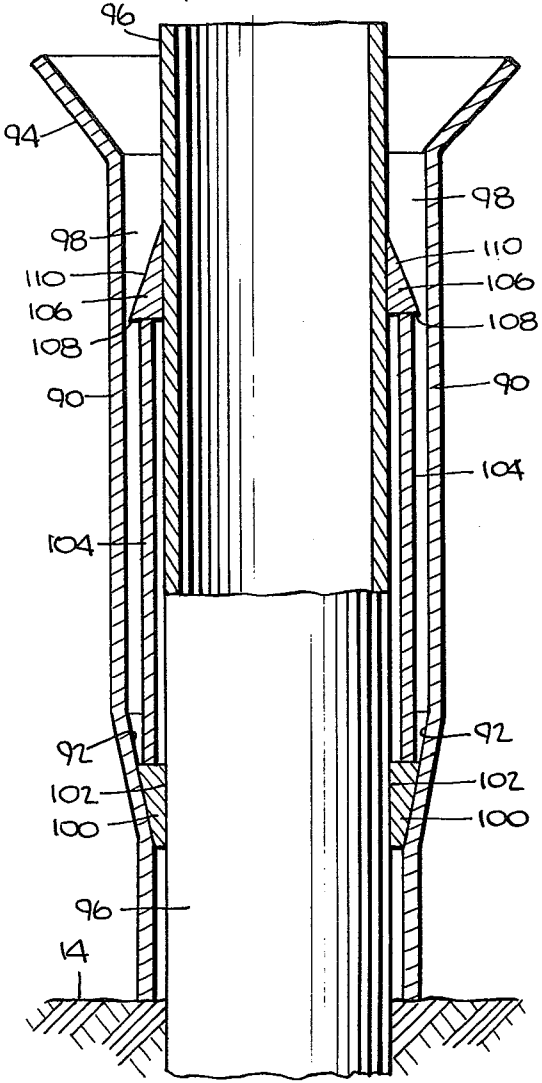
Figure 12:
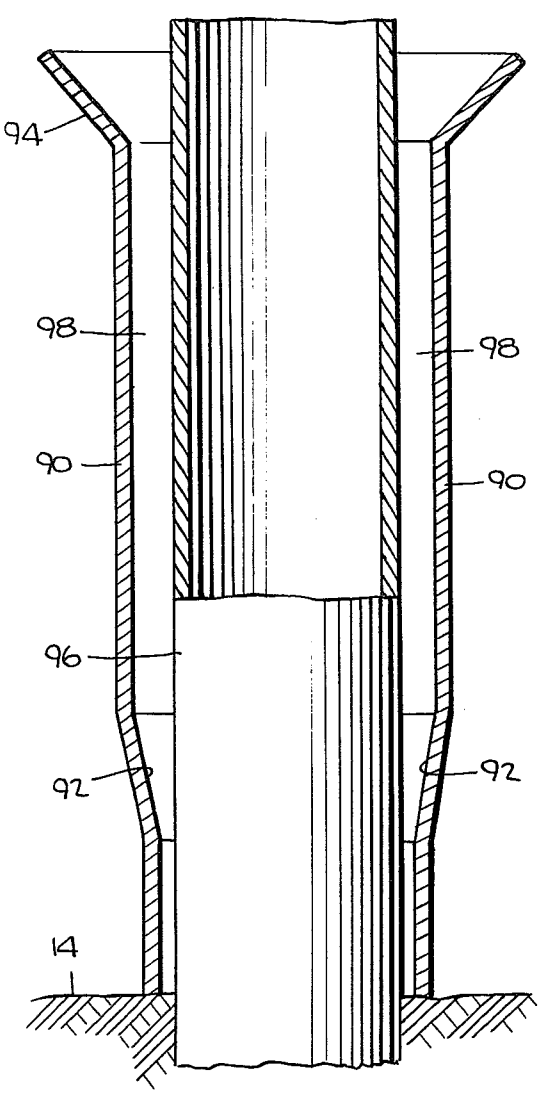

The embodiment illustrated in FIGS. 12–14 permits the locking of a sleeve to an anchor pile which extends up beyond the top of the sleeve. As shown in FIG. 12, there is provided a tubular sleeve 90, having lower tapering surface regions 92 and an upper stabbing point 94, as in the embodiment of FIGS. 4–9. An anchor pile 96 is driven down through the sleeve 90 and into the sea bed 14. As will be seen, the pile 96 extends up above the top of the sleeve 90 to an indefinite extent. An annular clearance 98 is provided between the pile and the sleeve.

After the pile 96 has been driven down through the sleeve 90 and into the sea bed 14, as shown in FIG. 12, a plurality of lower locking wedges 100 are inserted down through the clearance 98 so that they wedge between the tapering surface regions 92 of the sleeve and corresponding surface regions 102 of the anchor pile 96. As in the preceding embodiments the wedges 100 are distributed around the anchor pile 96. Thereafter an elongated, tubularly shaped bias weight 104 is lowered down over the pile 96 and into the clearance 98 until it comes to rest upon the tops of the lower locking wedges 100, as shown in FIG. 13. The bias weight 104 is of sufficient weight to maintain the necessary downward bias on the lower locking wedges 100 so that they become securely locked, frictionally, between the sleeve 90 and the anchor pile 96. The upper end of the bias weight 104, as shown in FIG. 13, is located below the upper end of the sleeve 90. Upper locking elements 106 are then lowered down around the pile 96 so that they come to rest on top of the bias weight 104 as shown in FIG. 13. These upper locking elements 106, as shown, are in the shape of inverted wedges having lateral surfaces 108, which rest on the top of the sleeve 106, and outwardly facing inclined surfaces 110, which flare outwardly toward the sleeve 90 in a downward direction.

As shown in FIG. 14, upper locking wedges 112 are then lowered down into place between the inclined surfaces 110 of the locking elements 106 and corresponding inner surface regions 114 of the sleeve 90. An upper bias weight 116 is then positioned on top of each of the upper locking wedges 112 to bias them downwardly into frictional locking engagement with the upper locking elements 106 and to force the upper locking elements 106, in turn, into frictional locking engagement with the anchor pile 96.

In the above described arrangement the lower wedges 100 provide vertical support, via the lower bias weight 104, for the upper locking elements 106 so that the pile 96 can extend up through the sleeve 90 by any desired amount. Also, it will be appreciated that the locking elements 106 frictionally engage the sides of the pile 96 whereas in the prior embodiments the locking cap rested on top of the pile. In both cases the necessary vertical restraint is thus provided between the outwardly inclined or tapered surfaces and the pile.

The lower and upper bias weights 104 and 116, as in the preceding embodiments, may be in the form of sleeves or rings, or they may be in the form of a plurality of individual weight segments associated with corresponding ones of their respective locking wedges 100 and 112. If desired, the bias weights may be formed integrally with their associated locking wedges. Also the upper locking elements 106 may be individually associated with corresponding segments of the lower bias weight 104 and, in fact, the individual upper locking elements 106 may be integrally formed with their associated lower bias weight segments.

While the specific dimensions of the various portions of the above-described anchoring arrangements are not critical to the present invention and can be readily calculated by those skilled in the art to accommodate the requirements of each particular application, for purposes of explanation and by way of example some representative dimensions are given below.

For an offshore drilling and exploration tower which is to operate in several hundred feet of water depth, e.g., greater than one hundred meters, each anchor pile may be expected to sustain a downward loading in the neighborhood of 4,000 tons and an upward loading in the range of 1,000 to 2,000 tons. In such case the anchor piles would have a diameter in the range of 48 to 60 inches (120–150 cm.). The sleeves may have a wall thickness of 1½ to 2 inches (3.8–5 cm.). The wedges and the surfaces they face have a shallow angle of convergence, e.g., 7°, to obtain a high frictional locking action. The parasitic weights themselves may be several tons.

The upper and lower wedge locking assemblies are preferably located near the upper and lower ends of the sleeves.

It will be appreciated from the foregoing that the present invention provides a safe, reliable and easy to assemble structure anchoring system which provides locking against relative movement both upwardly and downwardly. Further, when the invention is used in the anchoring of offshore towers good resistance to lateral forces imposed by wind, waves and water currents is obtained. Moreover, the present invention, it will be seen, requires considerably less structural material than prior art anchoring systems.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. Apparatus for anchoring a structure, said apparatus comprising an elongated anchor member adapted to be anchored at a given location, a tubular sleeve member adapted to be affixed to said structure and to surround said anchor member, first and second wedge type locking assemblies interposed between said sleeve and anchor members at longitudinally spaced apart locations therealong to prevent relative movement of said sleeve member in either a first or an opposite longitudinal direction with respect to said anchor member, the first wedge type locking assembly comprising means defining a first surface region on said sleeve member which faces and is inclined toward a corresponding first surface region on said anchor member as said surfaces extend in said first longitudinal direction, at least one first wedge element extending into and configured in accord with shape of the space between said first surface regions for locking same together when said first wedge element is moved in said first direction, the second wedge type locking assembly comprising means defining a second surface region on said anchor member which faces, and is inclined toward, a corresponding second surface region on said sleeve member as said surfaces extend in said first longitudinal direction, at least one second wedge element extending into and configured in accord with the shape of the space between said second surface regions when said second wedge element is moved in said first direction, means biasing said first and second wedge elements in said first longitudinal direction and the corresponding surface regions being held against movement in said opposite longitudinal direction with respect to their associated members.

2. Apparatus according to claim 1 wherein said first longitudinal direction is downwardly and wherein said wedge elements are biased into locking engagement by means of bias weight means arranged to press down on said wedge elements.

3. Apparatus according to claim 1 wherein said surface regions extend annularly about the space between said sleeve and anchor member.

4. Apparatus according to claim 1 wherein each of said locking assemblies includes a plurality of wedge elements.

5. Apparatus according to claim 1 wherein said inclined and corresponding surface regions of at least one of said locking assemblies are held against movement with respect to their asociated members by frictional forces produced by said wedge element.

6. Apparatus according to claim 1 wherein said first wedge type locking assembly is located below said second wedge type locking assembly.

7. Apparatus according to claim 5 wherein said means defining a second surface region on said anchor member comprises a locking cap which rests on said anchor member inside said sleeve, said locking cap being formed with a conical outer surface which includes said second surface region.

8. Apparatus according to claim 1 wherein said means defining a second surface region on said anchor member comprises a plurality of locking elements arranged inside said sleeve and having outer inclined surfaces which include said second surface region.

9. Apparatus according to claim 8 wherein said locking elements are frictionally held in engagement with said anchor member by said means biasing said second wedge elements in said first longitudinal direction.

10. Apparatus according to claim 9 wherein said locking elements are supported against movement in said first longitudinal direction by means of support elements extending in the space between wedge elements and said locking elements.

11. Apparatus according to claim 10 wherein said first longitudinal direction is downwardly and said support elements are bias weights which bias said first wedge elements.

12. A method for anchoring a structure to an elongated anchor pile driven into the earth, said method comprising the steps of arranging said structure so that a tubular sleeve near the bottom thereof extends around the upper end of an anchor pile, said sleeve having an inner surface region that tapers inwardly toward said pile in a downward direction, lowering a plurality of wedges down into the tapered space defined by said inner surface region of said sleeve and the corresponding surface region of said anchor pile, lowering bias weight means onto said wedges to force the wedges into frictional engagement with said inner and corresponding surface regions to lock said sleeve against upward movement relative to said anchor pile, positioning a locking member against said anchor pile within said sleeve and above said bias weight means so that said locking member is supported against vertical movement with respect to said pile, said locking member having an inclined outer surface region that inclines toward a corresponding surface region of said sleeve in a downward direction, lowering second wedges into the tapered space defined by said inclined outer surface region and the corresponding surface region of said sleeve and lowering second bias weight means onto said second wedges to force the wedges into frictional engagement with said outer and corresponding surface regions to lock said sleeve against downward movement relative to said anchor pile.

13. A method according to claim 12 wherein said structure is an offshore tower and wherein said locking member, said second wedges and said second bias weight means are lowered from above the water surface in which said tower stands.

14. A method according to claim 13 wherein said first wedge and first bias weight means are maintained in an annular cavity in said tubular member up along the inner tapering surface region of said sleeve when said structure with said sleeve is being positioned and then after said anchor pile is driven and extends up inside said sleeve said first wedges and said first bias weight means are released to become lowered into locking position by gravity.

15. A method according to claim 12 wherein said first wedges, said first bias weight, said locking member, said second wedges and said second bias weight are lowered in succession into position from above said anchor pile and said sleeve.

16. A method according to claim 15 wherein said locking member comprises at least one wedge shaped element and wherein said locking member is positioned to rest upon said first bias weight.

17. A method according to claim 12 wherein said structure is an offshore tower and wherein a plurality of said sleeves are affixed to the lower end of said tower before it is positioned on a sea bed.

18. A method according to claim 17 wherein said anchor piles are driven down through said sleeves and into the sea bed when said tower is set in place.

19. Apparatus for anchoring a structure to an elongated anchor member extending out of the earth, said apparatus comprising means forming first and second mutually facing surface portions adapted to be fixed, respectively, with respect to said structure and to said anchor member, said surface portions converging towards each other in a downward direction, at least one wedge element tapered to fit between said surface portions and bias weight means positioned on top of said wedge element to rest upon and to press downwardly on said wedge element to cause said element to maintain a continuous frictional interlock between said anchor member and said structure.

20. Apparatus according to claim 19 wherein said anchor member and said structure are formed with portions which cooperate to define an annular space therebetween, with said facing surface portions extending about said annular space.

21. Apparatus according to claim 20 wherein a plurality of said wedge elements are distributed about said annular space.

22. Apparatus according to claim 20 wherein said bias weight means extends annularly about said annular space.

23. Apparatus according to claim 21 wherein said bias weight means comprises a plurality of bias weight elements each arranged to press down upon an associated one of said wedge elements.

24. Apparatus according to claim 19 wherein said anchor member comprises an elongated element and said structure includes a tubular sleeve surrounding said anchor member.

25. Apparatus according to claim 24 wherein said facing surface portions extend about the annular space between said sleeve and anchor member.

26. Apparatus according to claim 19 wherein said apparatus comprises plural sets of facing surface portions and associated wedge elements and bias weight means separated longitudinally along said anchor member and said structure.

27. Apparatus according to claim 26 wherein one of said plural sets is constructed to resist relative movement between said anchor member and said structure in the downward direction and the other set is constructed to resist relative movement in the upward direction.

28. A method of anchoring a structure to an elongated anchor member extending up out of the earth, said method comprising the steps of causing said structure and anchor member to be positioned so that portions of said structure and of said anchor member extend adjacent each other, with said anchor member secured to the earth, positioning at least one wedge element, which is tapered inwardly in a downward direction, down between a pair of correspondngly tapered surface regions fixed, respectively, to said anchor member and to said structure and positioning bias weight means on said wedge elements to maintain a continuous downward force thereon to cause said wedge element to maintain a continuous frictional interlock between said anchor member and said structure.

29. A method according to claim 28 wherein said wedge element and bias weight means are held up against one of said surface regions out of engagement with the other surface region until said structure and said anchor member are in place and then releasing said wedge element and anchor member so that they fall down into locking position by their own weight.

30. A method according to claim 28 wherein said structure includes an elongated sleeve extending along said anchor member.

31. A method according to claim 30 wherein said sleeve and anchor member are configured to define first and second sets of said correspondingly tapered surface regions longitudinally displaced from each other along said sleeve and wherein wedge elements are positioned down between each of said sets.

32. A method according to claim 31 wherein the first set of said surface regions is formed by a downwardly and inwardly tapering region of said sleeve and wherein the second set is formed by providing an outwardly and downwardly tapering region on said anchor member.

33. A method according to claim 32 wherein said outwardly and downwardly tapering region on said anchor member is provided by lowering a locking cap so that it rests on said anchor member.

34. A method according to claim 32 wherein said outwardly and downwardly tapering region on said anchor member is provided by lowering wedge shaped locking elements down between said anchor member and said sleeve so that said locking elements are supported by the lowermost wedge elements.

35. A method according to claim 34 wherein said locking elements are positioned to rest upon the bias weight means which maintains a downward force on said lowermost wedge elements.

36. An offshore tower construction comprising an elongated framework structure positioned on a sea bed and extending up past the surface of the sea to support an elevated platform, at least one tubular sleeve attached to the lower end of said structure adjacent the sea bed, an elongated anchor pile extending down into and anchored to the sea bed, the upper end of said anchor pile extending up into said tubular sleeve, means forming first and second mutually facing surface portions fixed, respectively, with respect to said structure and to said anchor member, said surface portions converging toward each other in a downward direction, wedge elements tapered to fit between said surface portions and bias weight means positioned on top of said wedge elements to rest on and to press downwardly on said wedge elements to cause said elements to maintain a continuous frictional interlock between said anchor pile and said structure.

37. An offshore tower construction according to claim 36 wherein said sleeve is tapered inwardly and downwardly to form one of said mutually facing surface portions.

38. An offshore tower construction according to claim 36 wherein a plurality of said wedge elements are distributed about said mutually facing surface portions.

39. An offshore tower construction according to claim 36 wherein said bias weight means compress a plurality of bias weights each associated with and pressing down upon one of said wedge elements.

40. An offshore tower construction according to claim 36 wherein said construction includes two sets of said mutually facing surface portions each provided with associated wedge elements and bias weight means and each being fixed respectively with respect to said structure and to said anchor member at longitudinally displaced locations therealong.

41. An offshore tower construction according to claim 40 wherein one of said sets of mutually facing surface portions comprises a surface portion extending from a member fixed with respect to said anchor member and inclined to extend downwardly and toward its facing surface portion and wherein the other set of mutually facing surface portions comprises a surface portion extending from a member fixed with respect to said sleeve and inclined to extend downwardly and toward its facing surface.

42. A method of anchoring a structure to the earth, said method comprising the steps of driving anchor piles into the earth with the portion of the piles above the earth extending up into tubular sleeves secured to said structure, positioning tapered wedge elements into engagement with and between cooperating surfaces of said sleeves and piles, said cooperating surfaces also tapering toward each other in a downward direction and thereafter positioning bias weights on top of said wedge elements to maintain them in locking engagement between said sleeves and their associated piles.

43. A method according to claim 42 wherein said piles are driven through said sleeves.

44. A method according to claim 42 wherein said wedge elements and bias weights are held in said sleeve up along a tapered surface thereof and out of engagement with said anchor members until after they are driven out then releasing said wedge elements and bias weights so that they fall into locking position.

* * * * *

UNITED STATES PATENT AND TRADEMARK OFFICE

CERTIFICATE OF CORRECTION

PATENT NO. : 4,102,143

DATED : July 25, 1978

INVENTOR(S) : Lindsey J. Phares and George J. Gendron

It is certified that error appears in the above-identified patent and that said Letters Patent are hereby corrected as shown below:

Sheet 1 of 5, Fig. 3, uppermost numeral "32" to read -- 33 --.

Column 4, line 62, "32" to read -- 33 --;

Column 11, line 43, "an" (first occurrence) to read -- the --;

Column 14, lines 5, 29 and 35-36, "member" to read -- pile --;

Column 14, line 58, "members" to read -- piles --.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*